United States Patent [19]

Torii et al.

[11] Patent Number: 4,835,941

[45] Date of Patent: Jun. 6, 1989

[54] MECHANISM FOR OPENING THE COVER OF AN IMAGE RECORDING MEDIUM CASSETTE

[75] Inventors: Shumpeita Torii; Yutaka Isozaki, both of Kanagawa, Japan

[73] Assignee: Fuji Photo Film Co., Ltd., Kanagawa, Japan

[21] Appl. No.: 143,101

[22] Filed: Jan. 12, 1988

[30] Foreign Application Priority Data

Jan. 12, 1987 [JP] Japan ..... 62-5738
Jan. 29, 1987 [JP] Japan ..... 62-18920

[51] Int. Cl.[4] ..... B65B 43/38; B65B 43/30
[52] U.S. Cl. ..... 53/382; 53/386
[58] Field of Search ..... 53/381 R, 382, 381 A, 53/386; 248/363

[56] References Cited

U.S. PATENT DOCUMENTS 2,997,833 8/1961 Nigrelli et al. ..... 53/382
3,430,409 3/1969 Manfredonia et al. ..... 53/386 X
3,662,516 5/1972 Wiseman ..... 53/382 X
3,706,179 12/1972 Tanaka et al. ..... 53/386 X
3,706,180 12/1972 Kaneko et al. ..... 53/386
4,318,265 3/1982 Orsinger et al. ..... 53/386 X
4,354,336 10/1982 Azzaroni ..... 53/382 X
4,449,351 5/1984 Henderson ..... 53/382 X
4,478,023 10/1984 Becker ..... 53/382
4,514,958 5/1985 Hoorn ..... 53/382 X
4,776,152 10/1988 Kruk ..... 53/382 X

*Primary Examiner*—Horace M. Culver
*Attorney, Agent, or Firm*—Sughrue, Mion, Zinn, Macpeak and Seas

[57] ABSTRACT

A mechanism for opening the cover of an image recording medium cassette includes a support member angularly movable by a rotative drive source and supporting a swingable suction cup coupled to a suction device. When the rotative drive source is actuated, the suction cup is pressed against the upper surface of the cover to attract the same in response to activation of the suction device. Since the suction cup is swingable with respect to the support member, it can attract covers of various lengths which may be inclined at different angles when opened.

9 Claims, 9 Drawing Sheets

MECHANISM FOR OPENING THE COVER OF AN IMAGE RECORDING MEDIUM CASSETTE

BACKGROUND OF THE INVENTION

The present invention relates to a mechanism for opening the cover of an image recording medium cassette, and more particularly to a mechanism for automatically opening the cover of a cassette in an image reading device or the like to allow stored image recording mediums to be taken out so that the image recording mediums can be loaded into the image reading device in a light-shielded condition. The present present invention is particularly concerned with a mechanism which is capable of stably opening the covers of cassettes of different sizes dependent on the sizes of image recording mediums stored therein, is simple in structure, and can operate in as small a space as possible so that the image reading device can be reduced in size.

There has recently been developed and widely used, particularly in the medical field, a radiation image recording and reproducing system for producing the radiation-transmitted image of an object using a stimulable phosphor material capable of emitting light upon exposure to stimulating rays. When a certain phosphor is exposed to a radiation such as X-rays, $\alpha$-rays, $\beta$-rays, $\gamma$-rays, cathode rays, or ultraviolet rays, the phosphor stores a part of the energy of the radiation. When the phosphor exposed to the radiation is subsequently exposed to stimulating rays such as visible light, the phosphor emits light in proportion to the stored energy of the radiation. The phosphor exhibiting such a property is referred to as a "stimulable phosphor".

In the radiation image recording and reproducing system employing such a stimulable phosphor, the radiation image information of an object such as a human body is stored in a sheet having a layer of stimulable phosphor, and then the stimulable phosphor sheet is scanned with stimulating rays such as a laser beam to cause the stimulable phosphor sheet to emit light representative of the radiation image. The emitted light is then photoelectrically detected to produce an image information signal that is electrically processed for generating image information which is recorded as a visible image on a recording medium such as a photosensitive material or displayed as a visible image on a CRT or the like.

The radiation image recording and reproducing system includes an image reading device for reading the radiation image recorded on a stimulable phosphor sheet. The image reading device reads the radiation image as follows:

The stimulable phosphor sheet is two-dimensionally scanned by a light beam such as a laser beam, and light emitted from the stimulable phosphor sheet in response to application of the light beam is detected in time series by a light detector such as a photomultiplier or the like, for thereby obtaining image information. The two-dimensional scanning of the stimulable phosphor sheet with the light beam is effected by mechanically feeding the stimulable phosphor sheet in one direction for auxiliary scanning, while deflecting the light beam for main scanning in a direction normal to the direction in which the stimulable phosphor sheet is fed.

For recording an image on a stimulable phosphor sheet in an image recording device, an object to be imaged is exposed to radiation, and the stimulable phosphor sheet stored in a cassette is then exposed to the radiation having passed through the object for recording the radiation image on the stimulable phosphor sheet. The stimulable phosphor sheet as it is carried in the cassette is then loaded into the image reading device, in which the stimulable phosphor sheet is taken out of the cassette by a sheet delivery mechanism including a suction cup and delivered to a position where the sheet is scanned by the light beam.

One general cassette construction will be described with reference to FIG. 1 of the accompanying drawings.

A conventional cassette 2 has a casing 6 defining a chamber 4 for storing a stimulable phosphor sheet S therein and a cover 10 angularly movably mounted on one end of the casing 6 by means of a hinge 18.

The cassette 2 is loaded into an image reading device 12, for example, in which the cover 10 is opened by a suction disk or cup 14 to open the chamber 4 into the image reading device 12. Then, a sheet delivery mechanism including a suction cup 16 is operated to attract and pick up the stimulable phosphor sheet S, which is thereafter fed to an image scanning reader by a sheet feed mechanism, not shown.

For reading information from stimulable phosphor sheets S of different sizes, there have to be as many different cassettes 2 as the number of different sheet sizes. Cassettes of different sizes are naturally associated with covers of different sizes which are to be opened. Opening and closing the covers 10 of such different sixes with the same suction cup 14 poses a certain problem. More specifically, when a smaller cover 10 indicated by the dot-and-dash lines in FIG. 1 is to be opened, the cover 10 tends to be largely inclined vertically, and hence the angle formed between the axis of the shank supporing the suction cup 14 and the sheet surface attracted thereby is largely varied, making the suction cup 14 ineffective to attract the stimulable phosphor sheet S, which may then drop off the suction cup 14.

There has been proposed a cover opening mechanism 20, as shown in FIG. 2, having a multijoint link mechanism 18 for eliminating the above drawback. A rotative drive source 22 has a drive shaft to which is coupled a first arm 23 that is connected to a second arm 25 swingable about a pivot 24. The second arm 25 has a distal end to which a third arm 27 is copuled by means of a shaft 26, and a fourth shaft 29 is coupled to the third arm 27 by means of a shaft 28. A suction cup 14 is supported on the fourth arm 29 and directed toward the cover 10.

When the shaft of the rotative drive source 22 is rotated about its axis in the direction of the arrow A, the link mechanism 18 swings about the pivot 24 in the direction of the arrow B to cause the suction cup 14 which has attracted the cover 10 to open the cover 10.

Therefore, even if a cassette of a different size is loaded, the angle of inclination of the suction cup 14 with respect to the cover 10 is corrected by the third and fourth arms 27, 29.

As can readily be understood from FIG. 2, however, the link mechanism 18 is made up of a large number of parts, and operates in a large space to open and close the cover 10.

SUMMARY OF THE INVENTION

It is a general object of the present invention to provide a mechanism for opening the cover of an image recording medium cassette, the mechanism including a suction cup mounted on a support member swingable in response to actuation of an actuator, the suction cup being desplaceable when it is pressed against the cover so that the suction cup can attract a sheet in a stable position even if the cover is of a different size, the mechanism being made up of a small number of parts, and can open the cover within as small a space or range as possible.

A primary object of the present invention is to provide a mechanism for opening the cover of an image recording medium cassette, comprising: an actuator; an arm swingable in response to energization of the actuator; a support member angularly movably supported at one end thereof and coupled to the arm, the support member having a hole defined in the opposite end thereof; a coil spring mounted on the support member in surrounding relation to the hole; a tube extending through the coil spring and the hole and communicating with a suction device; a suction up attached to an end of the tube which is disposed on one side of the support member; and the arrangement being such that the suction cup is disposed in facing relation to the cover of the cassette storing at least one image recording medium therein, and then the actuator is operated to turn the arm to cause the suction cup to attract and open the cover upon activation of the suction device.

Another object of the present invention is to provide a mechanism for opening the cover of an image recording medium cassette, wherein the hole is in the form of a substantially oblong hole.

Still another object of the present invention is to provide a mechanism for opening the cover of an image recording medium cassette, wherein the coil spring is of a conical shape progressively smaller in diameter toward an upper end thereof.

Yet still another object of the present invention is to provide a mechanism for opening the cover of an image recording medium cassette, comprising: an actuator; support means angularly movable in response to energization of the actuator; a support shaft supporting suction cup means and a guide member; a side plate having a hole defined therein for limiting displacement of the guide member; and the arrangement being such that the interior is operated to turn the support means while the support means is being guided by the guide member to cause the suction means to face the cover of the cassette storing at least one image recording medium, and then the actuator is operated to cause the suction means to attract and open the cover.

A further object of the present invention is to provide a mechanism for opening the cover of an image recording medium cassette, wherein the support shaft supports a bearing held in rolling engagement with an upper surface of the support member.

A still further object of the present invention is to provide a mechanism for opening the cover of an image recording medium cassette, wherein the support means comprises a pair of parallel spaced support members, the support shaft extending between and being supported by the support members, the suction means comprising a plurality of suction cups mounted on the support shaft.

A yet further object of the present invention is to provide a mechanism for opening the cover of an image recording medium cassette, wherein the guide member is mounted on each of opposite ends of the support shaft.

Yet another object of the present invention is to provide a mechanism for opening the cover of an image recording medium cassette, wherein the hole defined in the side plate is of substantially triangular shape having a tapered lowermost end defined by an acute angle, the guide member having a tapered end defined by an acute angle for reaching the tapered lowermost end of the hole.

It is also an object of the present invention is to provide a mechanism for opening the cover of an image recording medium cassette, wherein the support means has a pad for pressing the cover of the cassette to lock the cover.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 5(*b*) is a side elevational view of the cassette cover opening mechanism of the present invention, when the cover is opened thereby;

FIG. 9(*b*) is a side elevational view of the cassette cover opening mechanism shown in FIG. 7, when the cover is opened thereby.

DETAILED DESCRIPTION OF THE PREFERRED EMBODIMENTS

Figure 3:
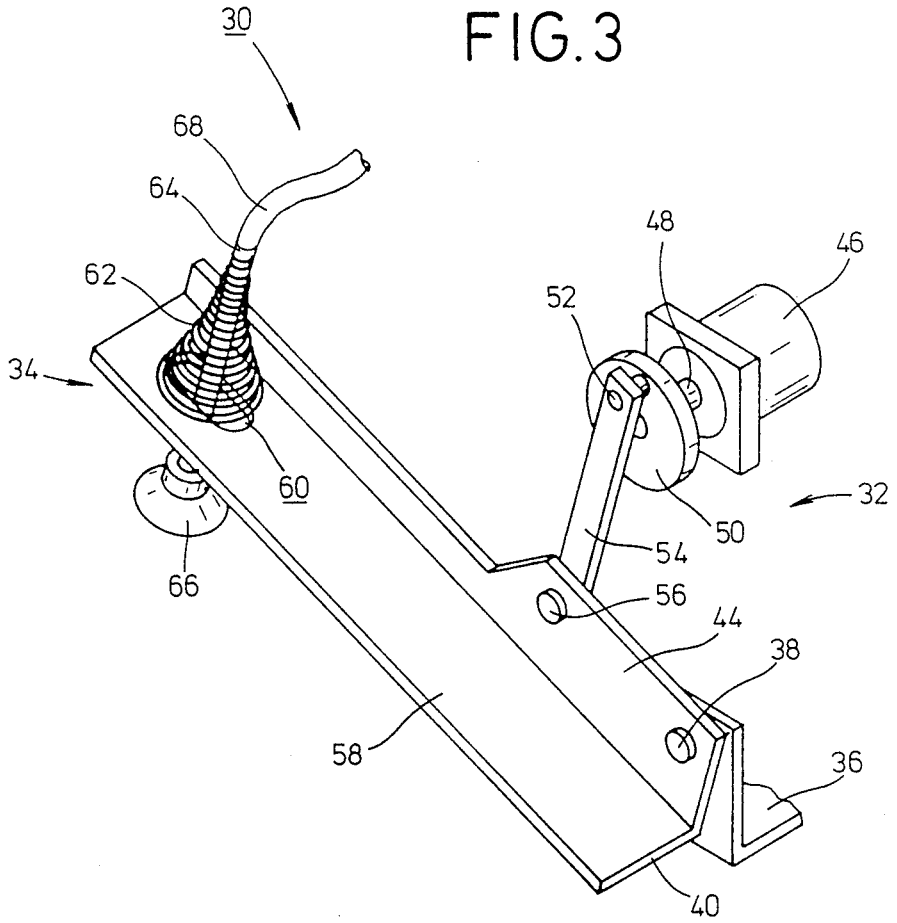
FIG. 3 is a perspective view of a mechanism for opening the cover of a cassette for a stimulable phosphor sheet, according to the present invention.

As illustrated in FIGS. 3 through 6, a mechanism 30 for opening the cover of an image recording medium cassette includes a swinging assembly 32 and a suction assembly 34. The swinging assembly 32 includes a bracket 36 disposed in a given position in a radiation image information reading device 100. As shown in FIG. 3, the bracket 36 supports one end of a side wall 44 of a support member 40 having an L-shaped cross section through a support shaft 38 extending horizontally. The support member 40 is swingable about the support shaft 48. The swinging assembly 32 also includes an actuator such as a rotative drive source 46 fixedly mounted in the radiation image information reading device 100 and having a rotatable drive shaft 48 extending horizontally parallel to the support shaft 38. A disc 50 is attached to the distal end of the drive shaft 48, and a shaft 52 is eccentrically attached to the disc 50. An arm 52 is pivotally secured at one end to the shaft 52 and has the opposite end pivotally coupled to the support member 40 through a shaft 56.

The support member 40 has a bottom wall 58 having a through hole 60 defined therein near its distal end remote from the support shaft 38, the hole 60 being in the form of a substantially oblong hole. A substantially conical coil spring 62 progressively smaller in diameter toward its upper end is disposed on the bottom wall 58 in surrounding relation to the hole 60. A hollow tube 64 extending loosely through the coil spring 62 and the hole 60 in a substantially downward direction is held in position by the vertex of the conical coil spring 62. A suction cup 66 is attached to one end of the tube 64 below the support member 40. The other end of the tube 64 is coupled to a tube 68 of a flexible material connected to a suction device (not shown).

The cassette cover opening mechanism 30 is basically constructed as described above. The radiation image information reading device 100 incorporating the cassette cover opening mechanism 30 therein will be described below.

Figure 4:
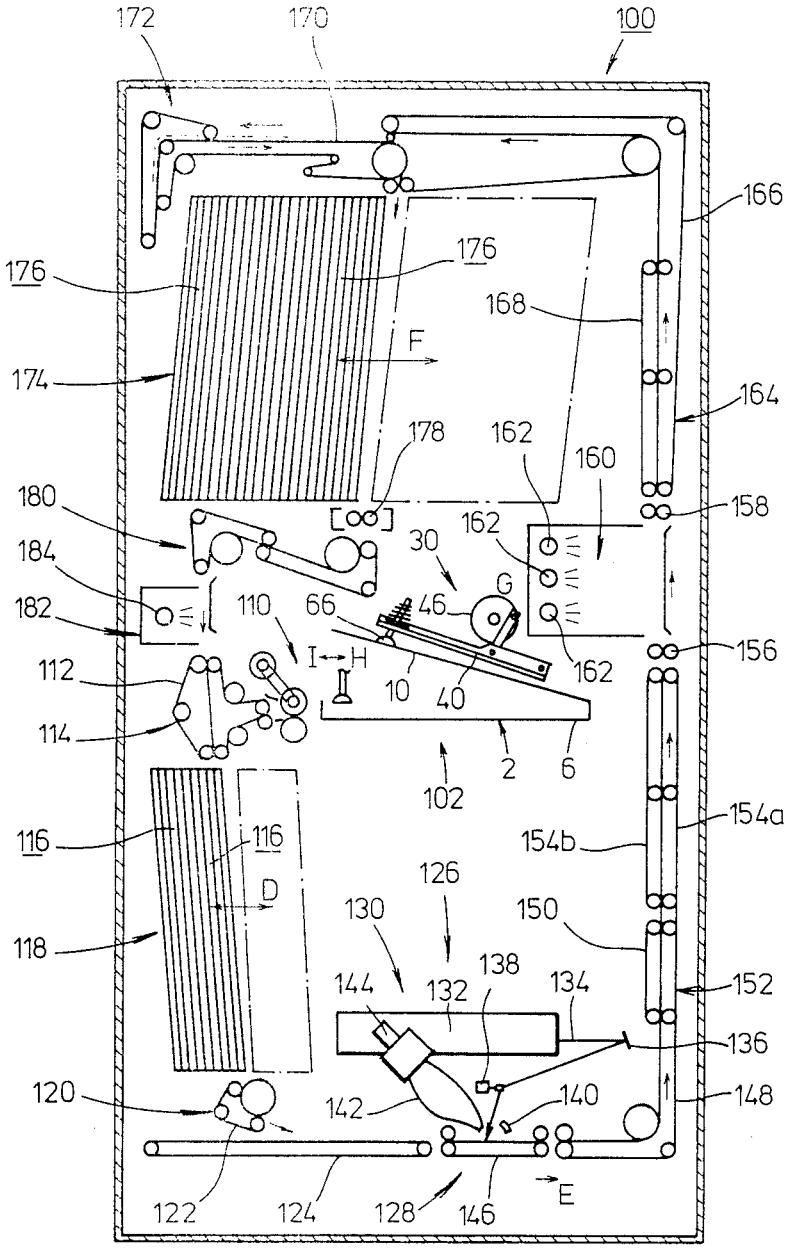
FIG. 4 is an elevational view of a radiation image reading device including the cassette cover opening mechanism of the present invention.

As shown in FIG. 4, the radiation image information reading device 100 has a cassette holder 102 for detachably holding a cassette 2, the cassette holder 102 being disposed substantially centrally in the reading device 100 and including the cassette cover opening mechanism 30.

A sheet delivery mechanism 100 including a suction cup operated by a drive source (not shown) for feeding a sheet at a time is disposed near the cassette holder 102.

First feed means 114 including a feed conveyor 112 is disposed in the vicinity of the sheet delivery mechanism 110. As shown in FIG. 4, the first feed means 114 is disposed above a first stacker 118 for temporarily storing a stimulable phosphor sheet S taken out of the cassette 2, the first stacker 118 having a plurality of sheet storage units 116 each for storing one stimulable phosphor sheet S therein. The first stacker 118 is movable in the direction of the arrow D by a motor or the like (not shown). The stimulable phosphor sheet S stored in each sheet storage unit 116 is placed on a bottom plate (not shown) thereof. By turning this bottom plate downwardly, the stimulable phosphor sheet S can be fed to a feed belt 124 through a feed belt 122 serving as a second feed means 120 located downwardly of the first stacker 118. The feed belt 124 has an end positioned closely to a reader 126.

The reader 126 includes third feed means 128 for feeding the stimulable phosphor sheet S in the direction of the arrow E (i.e., the auxiliary scanning direction) and scanning means 130. The scanning means 130 includes a laser beam source 132 for emitting a laser beam 134 which is scanned over the stimulable phosphor sheet S by a mirror 136 and a galvanometer mirror 138. A reflecting mirror 140 is disposed above the third feed means 128 for collecting light emitted from the stimulable phosphor sheet S which is scanned by the laser beam 134 in the main scanning direction. A light guide 142 is disposed along the main scanning line above the position where the sheet S is scanned. A photomultiplier 144 is mounted on the upper end of the light guide 142.

The third feed means 128 comprises a feed belt 146 followed by a feed belt 148 including a horizontal portion and a vertical portion that is held in sliding contact with another feed belt 150 serving as fourth feed means 152. A pair of feed belts 154*a*, 154*b* held in sliding contact with each other is positioned upwardly of the feed belt 148. Two roller pairs 156, 158 spaced from each other in the vertical direction are positioned above the feed belts 154*a*, 154*b*, with an erasure unit 160 located between the roller pairs 156, 158. The erasure unit 160 has a plurality of erasing light sources 162 such as sodium vapor lamps, tungsten lamps, or xenon lamps for completely erasing any radiation image remaining on the stimulable phosphor sheet S from which the radiation image has been read in the reader 126.

The roller pair 158 is disposed below fifth feed means 164 comprising a feed belt 166 including a horizontal upper portion and a vertical portion held in sliding contact with a short feed belt 168. The horizontal upper portion of the feed belt 166 is located adjacent to sixth feed means 172 including a feed belt 170. The stimulable phosphor sheet S that has reached the sixth feed means 172 is angularly dispaced 180° so as to be fed into a second stacker 174.

The second stacker 174 is of a structure identical to that of the first stacker 118. The second stacker 174 includes a plurality of sheet storage units 176 and is movable in the direction of the arrow F by a motor or the like. The second stacker 174 is positioned above a roller pair 178 disposed near seventh feed means 180 which feeds the stimulable phosphor sheet S supplied from the second stacker 174 to an auxiliary erasure unit 182 comprising an erasing light source 184. The stimulable phosphor sheet S that has passed through the auxiliary erasure unit 182 is stored into the cassette 2 by the sheet delivery mechanism 110.

A process of taking a sheet S from the cassette 20 will be described below.

Figure 5A:
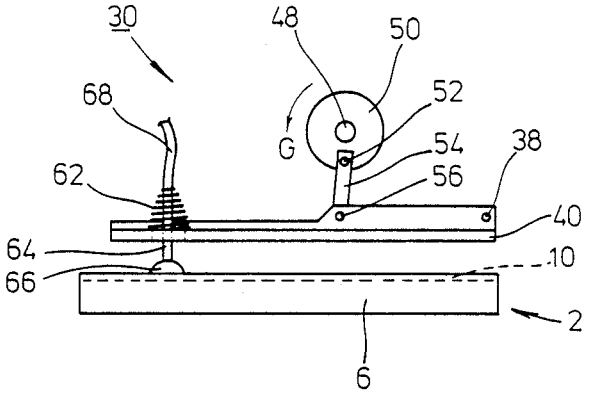
FIG. 5(*a*) is a side elevational view of the cassette cover opening mechanism of the present invention, when a cover is closed thereby.
Figure 5B:
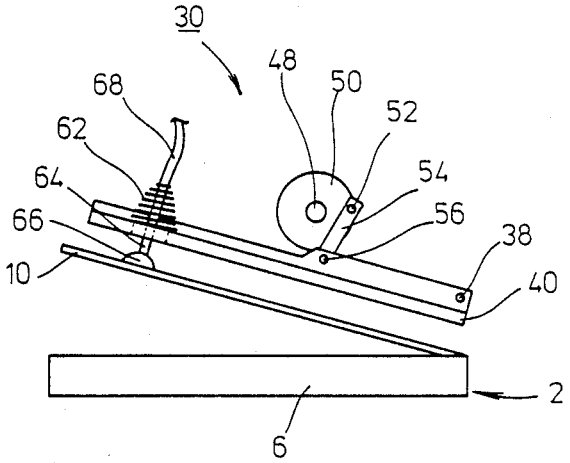

First, the cassette S is located into the reading device 100 in a light-shielding condition. Then, as shown in FIGS. 3 and 5(*a*), the rotative drive source 46 of the cover opening mechanism 30 is energized to cause the shaft 48 to rotate the disc 50 slowly in the direction of the arrow G. The arm 54 pivotally connected to the shaft 52 is displaced downwardly to allow the support member 40 to turn about the support shaft 38, until the suction cup 66 is pressed against the cover 10 of the cassette 2. The suction cup 66 supported through the coil spring 62 is held in communication with the suction device (not shown) via the tubes 64, 68, as described above. Therefore, by actuating the suction device, the upper surface of the cover 10 of the cassette 2 is attracted to the suction cup 66. Thereafter, the rotative drive source 46 is energized again to enable the suction cup 66 to open the cover 10 under suction, whereupon the cassette 2 is opened in the radiation image information reading device 100, as illustrated in FIG. 5(*b*).

Figure 6:
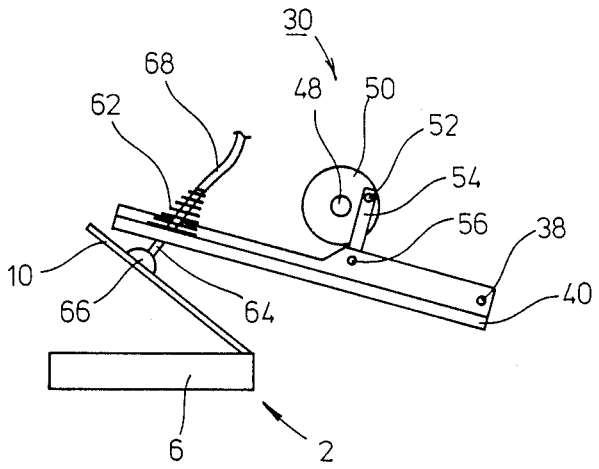
FIG. 6 is a side elevational view of the cassette cover opening mechanism of the present invention, when a cover swingable at a different radius is opened thereby.

The cover opening mechanism 30 can open the cover of a cassette of a different size. More specifically, as shown in FIG. 6, the angle of inclination of the cover 10 of the cassette 2 when the cover 10 is opened is larger than that of the cover 10 shown in FIG. 5(*b*), and the support member 40 and the cover 10 swing at different radii. Therefore, the support member 40 and the cover 10 are brought out of parallel to each other when the cover 10 is opened, a condition different from that shown in FIGS. 5(*a*) and 5(*b*). However, since the coil spring 62 is elastically deformed to absorb such difference between the angles of inclination, the suction cup 66 can follow the inclination of the cover 10, while allowing the axis of the tube 64 to lie substantially perpendicularly to the direction in which the cover 10 extends, so that the suction cup 10 can reliably attract the cover 10. At this time, the tube 64 is freely displaceable in the oblong hole 60.

Then, the sheet delivery mechanism 110 is operated. As shown in FIG. 4, the suction cup communicating with a non-illustrated suction device is moved in the direction of the arrow H and then downwardly by the drive source (not shown) to attract a stimulable phosor sheet S. The suction cup is then moved with the stimulable phosphor sheet S upwardly and then in the direction of the arrow I. By inactivating the suction device, the stimulable phosphor sheet S falls off the suction cup into the first feed means 114.

The stimulable phosphor sheet S is fed vertically downwardly by the first feed means 114 into one of the sheet storage units 116 of the first stacker 118. The stimulable phosphor sheet S thus fed or a stimulable phosphor sheet S stored in another sheet storage unit 116 is then fed toward the second feed means 120. The stimulable phosphor sheet S is then fed toward the reader 126 by the second feed means 120 and the feed belt 122.

The stimulable phosphor sheet S that has arrived at the reader 126 is fed in the auxiliary scanning direction (indicated by the arrow E) by the feed belt 146 of the third feed means 128, and at the same time the scanning means 130 is energized. The laser beam 134 emitted from the laser beam source 132 is reflected by the mirror 136 to the galvanometer mirror 138, which is swung to scan the laser beam 134 over the sheet S. Light emitted from the sheet S upon exposure to the laser beam 134 is directly applied, or is reflected by the reflecting mirror 140, to the light guide 142, and then is converted by the photomultiplier 144 to an electric signal that is supplied to an image recording device or the like.

The stimulable phosphor sheet S from which the recorded radiation image has been read is fed to the roller pair 156 by the feed belt 148, the fourth feed means 152 including the feed belt 148, and the feed belts 154*a*, 154b, and then fed by the roller pair 156 into the erasure unit 160. In the erasure unit 160, the erasing light sources 162 are energized to apply light to the stimulable phosphor sheet S for completely erasing remaining radiation image therefrom. The stimulable phosphor sheet S which has left the erasure unit 160 is fed vertically upwardly by the feed belts 166, 168 of the fifth feed means 164, and then is directed horizontally to reach the sixth feed means 172. The stimulable phosphor sheet S is turned 180° in its direction of feed by the sixth feed means 172, and stored into one of the sheet storage units 176 of the second stacker 174.

The stimulable phosphor sheet S that has been taken out of the cassette 2 and stored in the sheet storage unit 176 is thereafter fed by the roller pair 178 to the seventh feed means 180, by which the sheet S is moved across the auxiliary erasure unit 182. The stimulable phosphor sheet S is subjected to secondary image erasure in the auxiliary erasure unit 182, after which the stimulable phosphor sheet S is fed to the sheet delivery mechanism 110. Thereafter, the sheet S is attracted by the suction cup which is lowered, and is delivered with the suction cup in the direction of the arrow H until it is completely stored in the cassette 2.

After the stimulable phosphor sheet S has been placed in the cassette 2, the suction device is inactivated to release the sheet S, and the suction cup is elevated and moved in the direction of the arrow I. Then, the support member 40 of the cover opening mechanism 30 is pivotally lowered by the rotative drive source 46, and the suction cup 66 is inactivated to close the cover 10. Thereafter, the cassette 2 is removed from the cassette holder 102, and, if necessary, a new cassette 2 storing stimulable phosphor sheets S with image information recorded thereon may loaded into the cassette holder 102.

With the above embodiment, the covers of cassettes having different sizes or covers of different lengths can reliably be opened, without the danger for the covers to drop off due to suction failure.

Figure 1:
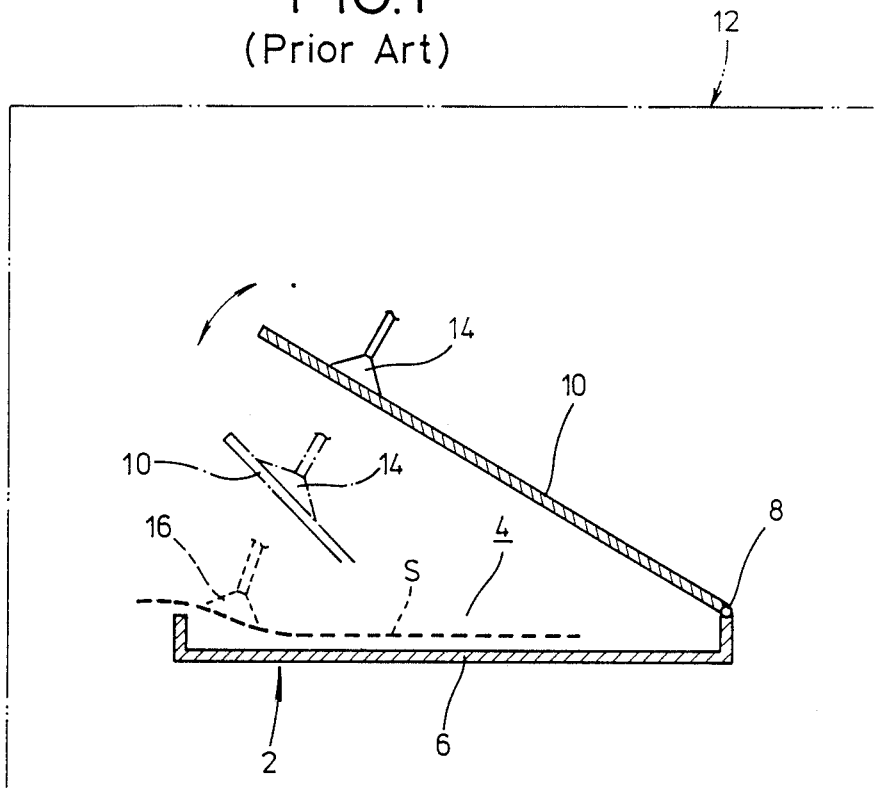
FIG.1 (Prior Art)
FIG. 1 is a schematic cross-sectional view of a conventional cassette for a stimulable phosphor sheet.
Figure 2:
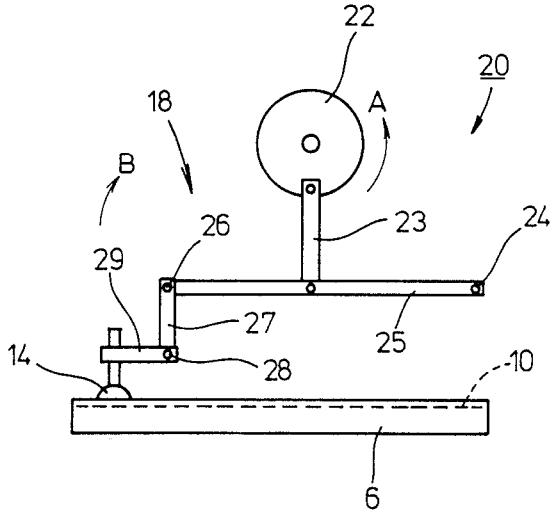
FIG.2 (Prior Art)
FIG. 2 is a schematic side elevational view of a conventional mechanism for opening the cover of a cassette for a stimulable phosphor sheet.

The cover opening mechanism 30 employs the coil spring for supporting the tube and the suction cup, the coil spring being much less costly than the many link members of the conventional cover opening mechanism as shown in FIG. 2. Therefore, the cover opening mechanism according to the aforesaid embodiment is simple in structure and inexpensive to manufacture.

The cover 10 can be of a selected length long enough to allow the sheet S to be taken out of the cassette. As shown in FIG. 4, the region or volume occupied in the reading device 10 by the cover opening mechanism 30 for opening and closing the cover 10 is so small that the range of selectable sheet sizes may be increased, and the reading device 100 may be reduced in size.

A mechanism for opening the cover of an image recording medium cassette according to another embodiment of the present invention will be described below. Those parts which are identical to those of the preceding embodiment are denoted by identical reference numerals, and will not be described in detail.

Figure 7:
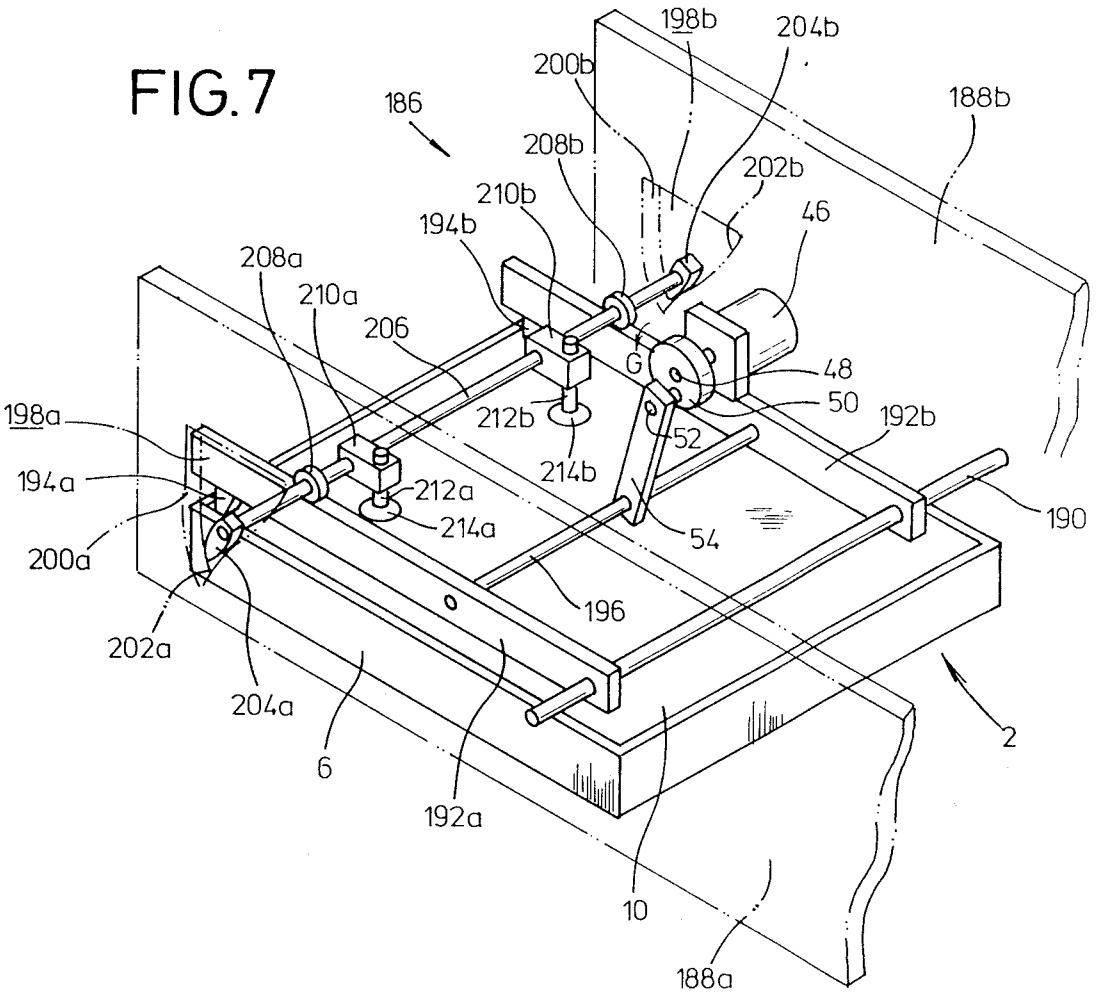
FIG. 7 is a perspective view of of a mechanism for opening the cover of a cassette for a stimulable phosphor sheet, according to another embodiment of the present invention.

As shown in FIG. 7, a cover opening mechanism 186 according to the second embodiment is disposed between a pair of parallel vertical side plates 188*a*, 188*b* located at a given position in the radiation image information reading device 100. A suport shaft 190 extends between and is rotatably supported by the side plates 188*a*, 188*b*. The support shaft 190 supports ends of two spaced support members 192*a*, 192*b* extending parallel to the side plates 188*a*, 188*b* and pivotally movable about the support shaft 190. A pair of locking pads 194*a*, 194*b* is attached to the lower ends of the other end of the suport members 192*a*, 192*b*, respectively.

A rotative actuator mechanism including the same rotative drive source 46 as the rotative drive source 46 of the preceding embodiment is mounted on the side plate 188*b*. The rotative drive source 46 is operatively coupled by the arm 54 to a shaft 196 parallel to the support shaft 190. The support shaft 190 supports the support members 192*a*, 192*b* at its opposite end portions, respectively.

The side plates 188*a*, 188*b* have holes 198*a*, 198*b* of an inverted triangular shape which are defined in the vicinity of distal ends of the side plates 188*a*, 188*b*, respectively. The holes 198*a*, 198*b* are defined by inner surfaces 200*a*, 202*a*; 200*b*, 202*b*, respectively, the inner surfaces 200*a*, 202*a* forming an acute angle therebetween and the inner surfaces 200*b*, 202*b* forming an acute angle therebetween. Two guide members 204*a*, 204*b* each substantially in the form of a wedge with its tip end tapered at an acute angle and directed vertically downwardly engage respectively in the holes 198*a*, 198*b*. The guide members 204*a*, 204*b* are mounted respectively on the opposite ends of a support shaft 206 parallel to the support shaft 190. Two bearings 208*a*, 208*b* are disposed on the support shaft 206 in abutment against the support members 192*a*, 192*b*, respectively. The support shaft 206 also supports thereon a pair of rectangular holders 210*a*, 210*b* positioned between the bearings 208*a*, 208*b*. The holders 210*a*, 210*b* hold hollow tubes 212*a*, 212*b*, respectively, oriented vertically downwardly, and respective suction cups 214*a*, 214*b* are mounted on the lower distal ends of the tubes 212*a*, 212*b*, respectively. The tubes 212*a*, 212*b* are connected to respective resilient tubes (not shown) which are coupled to a suction device (not shown).

The cover opening mechanism 186 is of the basic construction as described above. The cover opening mechanism 186 is associated with lock mechanisms which will be described with reference to FIG. 8.

Figure 8:
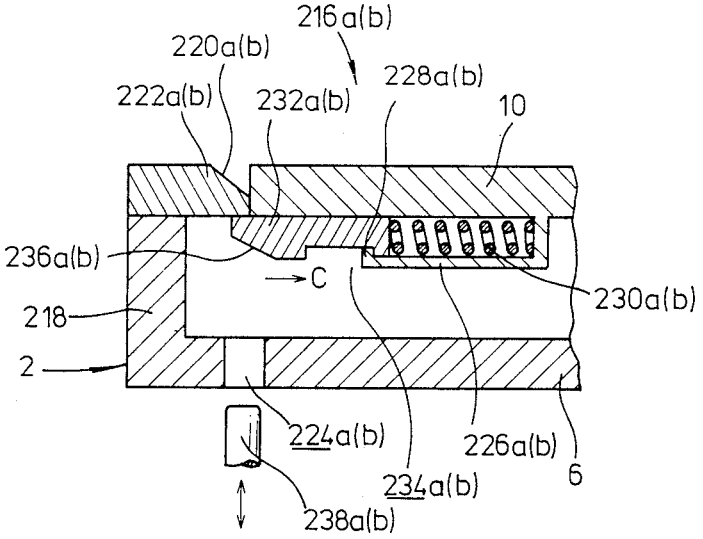
FIG. 8 is a fragmentary cross-sectional view of a cassette lock mechanism in a radiation image reading device incorporating therein the cassette cover opening mechanism shown in FIG. 7.

FIG. 8 shows lock mechanisms 216*a*(*b*) for the cassette 2. The cassette 2 comprises a casing 6 having a side wall 218 having an upper surface on which there are disposed locking projections 222*a*(*b*) having downwardly slanting surfaces 220*a*(*b*), respectively. The casing 6 includes a bottom wall having holes 224*a*(*b*) defined vertically therethrough. The holes 224*a*(*b*) serve to insert therethrough presser pins (described later on) for releasing the lock mechanisms.

Retainers 226*a*(*b*) of a small wall thickness are integrally disposed on the lower surface of the cover 10, the retainers 226*a*(*b*) having engaging ridges 228*a*(*b*) on their distal ends. The retainers 226*a*(*b*) and the cover 10 jointly define chambers therebetween in which coil springs 230*a*(*b*) are accommodated. Fingers 232*a*(*b*) are displaceably supported in the retainers 226*a*(*b*) in engagement with the distal ends of the coil springs 230*a*(*b*). The fingers 232*a*(*b*) have respective recesses 234*a*(*b*) defined in lower surfaces thereof and receiving the ridges 234*a*(*b*) therein. Therefore, the fingers 232*a*(*b*) are displaceable over a distance defined by the recesses 234*a*(*b*). The fingers 232*a*(*b*) have slanting surfaces 236*a*(*b*) on their distal ends, the slanting surfaces 236*a*(*b*) being normally positioned to face the holes 224*a*(*b*), respectively, under the bias of the coil springs 230*a*(*b*).

Presser pins 238*a*(*b*) are disposed underneath the cassette 2 and operatively coupled to an actuator (not shown). When the actuator is operated, the presser pins 238*a*(*b*) are inserted upwardly through the respective holes 224*a*(*b*) to release the lock mechanisms 216*a*(*b*).

The cover opening mechanism 186 operates as follows: In FIG. 8, when the presser pins 238*a*(*b*) are moved upwardly by the actuator, they enter the respective holes 224*a*(*b*) and abut against the respective slanting surfaces 236*a*(*b*) of the fingers 232*a*(*b*). Continued upward movement of the presser pins 238*a*(*b*) displaces the fingers 236*a*(*b*) in the direction of the arrow C against the resiliency of the coil springs 230*a*(*b*) for thereby releasing the lock mechanisms 216*a*(*b*) to free the cover 10.

Figure 9A:
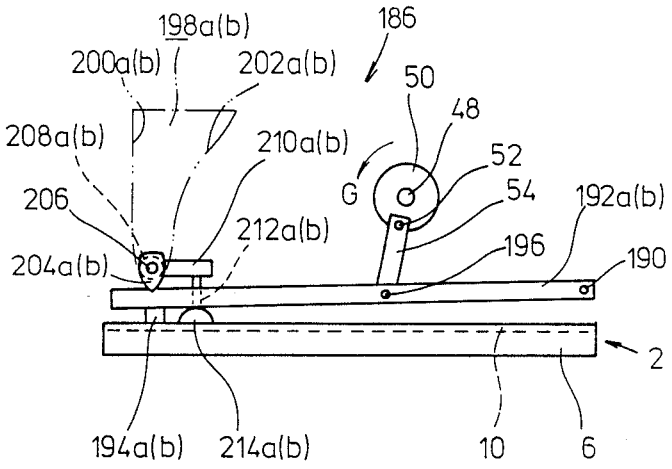
FIG. 9(*a*) is a side elevational view of the cassette cover opening mechanism shown in FIG. 7, when a cover is closed thereby.
Figure 9B:
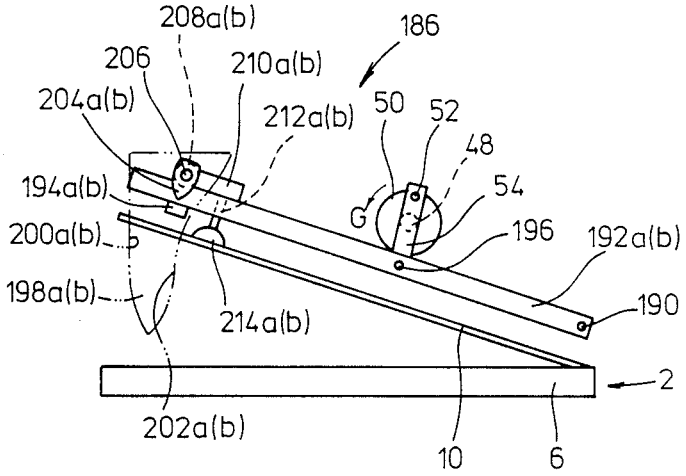

Then, as illustrated in FIGS. 7, 9(*a*) and 9(*b*), the rotative drive source 46 of the cover opening mechanism 186 is actuated to cause the shaft 48 to rotate the disc 50 slowly in the direction of the arrow G. The arm 54 pivotally coupled to the shaft 52 is now moved vertically downwardly to enable the shaft 196 to turn the support members 192*a*, 192*b* downwardly about the support shaft 190. The support shaft 206 rotatably supported by the bearings 208*a*, 208*b* held against the upper surfaces of the respective support members 192*a*, 192*b* is displaced downwardly. As the guide members 204*a*, 204*b* on the opposite ends of the support shaft 206 are displaced downwardly in the holes 198*a*, 198*b*, the guide members 204*a*, 204*b* slide downwardly against the respective inner surfaces 202*a*, 202*b* and are guided thereby until the sharply tapered distal tips thereof reach the downwardly tapered ends of the holes 198*a*, 198*b* where the inner surfaces 200*a*, 202*a*; 200*b*, 202*b* join each other.

While the guide members 204*a*, 204*b* are being displaced in the holes 198*a*, 198*b*, the support shaft 206 supporting the guide members 204*a*, 204*b* are also displaced together with the suction cups 214*a*, 214*b*. As a result, the bearings 208*a*, 208*b* roll on the support members 192*a*, 192*b*, respectively. The suction cups 214*a*, 214*b* are now caused to be pressed against the cover 10 of the cassette 2, as shown in FIG. 9(*a*). By activating the suction device, the suction cups 214*a*, 214*b* supported on the support shaft 206 through the holders 210*a*, 210*b* attract the upper surface of the cover 10. Then, the rotative drive source 46 is actuated again to enable the suction cups 214*a*, 214*b* to open the cover 10 under suction, thus opening the cassette 2 in the reading device 100, as shown in FIG. 9(*b*).

Figure 10:
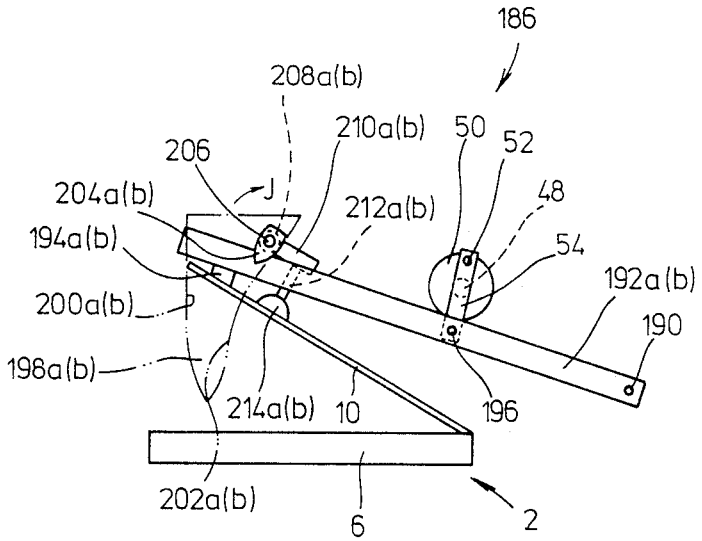
FIG. 10 is a side elevational view of the cassette cover opening mechanism shown FIG. 7, when a cover swingable at a different radius is opened thereby.

The cover opening mechanism 186 can open the cover of a cassette of a different size. As shown in FIG. 10, the angle of inclination of the cover 10 of the cassette 2 when the cover 10 is opened is larger than that of the cover 10 shown in FIG. 9(*b*), and the support members 192*a*, 192*b* and the cover 10 swing at different radii. Therefore, the support members 192*a*, 192*b* and the cover 10 are brought out of parallel to each other when the cover 10 is opened, a condition different from that shown in FIGS. 9(*a*) and 9(*b*). However, since the support shaft 206 is angularly displaced by the bearings 208*a*, 208*b* in the direction of the arrow J and also displaced along the support members 192*a*, 192*b* to absorb such difference between the angles of inclination, the suction cups 214*a*, 214*b* can follow the inclination of the cover 10, while allowing the axes of the tubes 212*a*, 212*b* to lie substantially perpendicularly to the direction in which the cover 10 extends, so that the suction cups 214, 214*b* can reliably attract the cover 10. At this time, the tubes 204*a*, 204*b* are freely displaceable in the holes 198*a*, 198*b*.

A sheet S is then taken out of the cassette 2, processed in the reading device 100, and then stored again in the cassette 2, in the same manner as described with reference to the preceding embodiment.

The support members 192*a*, 192*b* are now lowered by the rotative drive source 46 and the suction cups 214*a*, 214*b* are inactivated. Then, as shown in FIG. 8, the slanting surfaces 236*a*(*b*) of the fingers 232*a*(*b*) are brought into abutment against the respective slanting surfaces 220*a*(*b*) of the locking projections 222*a*(*b*). Upon continued downward angular movement of the support members 192*a*, 192*b* caused by the rotative drive source 46, the locking pads 194*a*, 194*b* (FIG. 9(*a*)) engage the upper surface of the cover 10. Further depression of the locking pads 194*a*, 194*b* forces the slanting surfaces 236*a*(*b*) of the fingers 232*a*(*b*) to slide along the slanting surfaces 236*a*(*b*) of the projections 222*a*(*b*) in the direction of the arrow C (FIG. 8) against the bias of the coil springs 230*a*(*b*). In response to continued depression of the locking pads 194*a*, 194*b*, the distal end of the cover 10 confronts the locking projections 222*a*(*b*), whereupon the fingers 232*a*(*b*) are resiliently snapped toward the side wall 218 and below the locking projections 220*a*(*b*) under the resilient forces of the coil springs 230*a*(*b*), thus locking the cover 10 on the casing 6.

With the above embodiment, when the cover of a cassette of a different size, or a cover of a desired length, or especially a small cover, is opened, the support shaft which supports the suction cups are angularly displaced by the guide members to absorb the difference between the angles of inclination of the support members and the cover. The suction cups are thus allowed to follow the cover and reliably attract the cover. The cover opening mechanism includes the locking pads associated with the mechanism for locking the cover of the cassette. The reading device is therefore made simpler in structure.

According to the present invention, as described above, the suction cup or cups in the cover opening mechanism for attracting and opening the cover of the image recroding medium cassette are arranged to absorb any difference between the angles of inclination of the support member or members and the cover, especially when the cover is of a small size. Therefore, the suction cup or cups can follow the cover to reliably attract the cover.

The principles of the present invention are also applicable to a mechanism for opening the cover of a cassette which stores ordinary X-ray films.

Although certain preferred embodiments have been shown and described, it should be understood that many changes and modifications may be made therein without departing from the scope of the appended claims.

What is claimed is:

1. A mechanism for opening the cover of an image recording medium cassette, comprising:

an actuator;

an arm swingable in response to energization of said actuator;

a support member angularly movably supported at one end thereof and coupled to said arm, said support member having a hole defined in the opposite end thereof;

a coil spring mounted on said support member in surrounding relation to said hole;

a tube extending through said coil spring and said hole and communicating with a suction device;

a suction cup attached to an end of said tube which is disposed on one side of said support member; and the arrangement being such that said suction cup is disposed in facing relation to the cover of the cassette storing at least one image recoridng medium therein, and then said actuator is operated to turn said arm to cause said suction cup to attract and open said cover upon activation of said suction device.

2. A mechanism according to claim 1, wherein said hole is in the form of a substantially oblong hole.

3. A mechanism according to claim 1 or 2, wherein said coil spring is of a conical shape progressively smaller in diameter toward an upper end thereof.

4. A mechanism for opening the cover of an image recording medium cassette, comprising:

an actuator;

support means angularly movable in response to energization of said actuator;

a support shaft supporting suction cup means and a guide member;

a side plate having a hole defined therein for limiting displacement of said guide member; and the arrangement being such that said actuator is operated to turn said support means while the support means is being guided by said guide member to cause the suction means to face the cover of the cassette storing at least one image recording medium, and then said actuator is operated to cause said suction means to attract and open said cover.

5. A mechanism according to claim 4, wherein said support shaft supports a bearing held in rolling engagement with an upper surface of said support member.

6. A mechanism according to claim 4, wherein said support means comprises a pair of parallel spaced support members, said support shaft extending between and being supported by said support members, said suction means comprising a plurality of suction cups mounted on said support shaft.

7. A mechanism according to claim 6, wherein said guide member is mounted on each of opposite ends of said support shaft.

8. A mechanism according to claim 4 or 7, wherein said hole defined in said side plate is of substantially triangular shape having a tapered lowermost end defined by an acute angle, said guide member having a tapered end defined by an acute angle for reaching said tapered lowermost end of said hole.

9. A mechanism according to claim 4 or 6, wherein said support means has a pad for pressing the cover of the cassette to lock said cover.

* * * * *